US006529141B1

(12) United States Patent
Hanebeck et al.

(10) Patent No.: US 6,529,141 B1
(45) Date of Patent: Mar. 4, 2003

(54) SYSTEM AND METHOD FOR TRANSMITTING A TRIGGERED ALARM

(75) Inventors: Hanns-Christian Hanebeck, Addison, TX (US); John Sweitzer, Plano, TX (US)

(73) Assignee: Globe Ranger Corporation, Richardson, TX (US)

( * ) Notice: Subject to any disclaimer, the term of this patent is extended or adjusted under 35 U.S.C. 154(b) by 0 days.

(21) Appl. No.: 09/777,509

(22) Filed: Feb. 6, 2001

Related U.S. Application Data

(60) Provisional application No. 60/218,295, filed on Jul. 14, 2000.

(51) Int. Cl.[7] ..... G08G 1/123

(52) U.S. Cl. ..... 340/988; 340/990; 701/210

(58) Field of Search ..... 340/988, 990, 340/995, 825.3; 701/207, 210, 211, 213

(56) References Cited

U.S. PATENT DOCUMENTS 3,786,422 A * 1/1974 Lubkin ..... 340/825.3
5,334,974 A 8/1994 Simms et al. ..... 340/990
5,359,529 A * 10/1994 Snider ..... 701/210
5,489,898 A * 2/1996 Shigekusa et al. ..... 340/988
5,497,149 A * 3/1996 Fast ..... 340/988
5,541,845 A * 7/1996 Klein ..... 701/207
5,710,559 A 1/1998 Krogmann ..... 340/963
5,828,322 A * 10/1998 Eberhard ..... 340/988
5,983,161 A 11/1999 Lemelson et al. ..... 340/903
6,104,980 A * 8/2000 Sato et al. ..... 701/211
6,211,798 B1 * 4/2001 Albrecht et al. ..... 340/990
6,240,365 B1 * 5/2001 Bunn ..... 701/213

* cited by examiner

*Primary Examiner*—John Tweel

(57) ABSTRACT

A system and method for transmitting a triggered alarm is presented. The alarm is detected by a sensor on an asset that includes a circuit containing a global positioning system (GPS) receiver, a wireless communication unit, a processing unit, a sensor unit and a storage unit operably coupled to one another. The storage unit comprises locations of the asset on a predefined route where events (such as, for example, a door of an asset opening) are expected and the wireless communication unit comprises a wireless transmitter and a wireless receiver. The sensor monitors a portion of the asset (such as, for example, the doors of the asset) while the asset travels along the predefined route. If the portion of the asset triggers an alarm, a current location of the asset is received via the GPS receiver and the event is compared with the locations of the asset on the predefined route. If the event is not expected at the current location, the wireless transmitter sends the alarm and the event to a data processing system.

45 Claims, 2 Drawing Sheets

SYSTEM AND METHOD FOR TRANSMITTING A TRIGGERED ALARM

RELATED APPLICATIONS

The present disclosure claims the benefit of Provisional Patent Application No. 60/218,295, filed on Jul. 14, 2000, titled System and Method For Programming a Route of An Asset and assigned to the assignee of the present invention. Further, the present disclosure is related to: patent application Ser. No. 09/642,293, filed on Aug. 18, 2000, titled System and Method For Location Polling of Independent Devices in a Communication Network, Provisional Patent Application No. 60/218,295, filed on Jul. 14, 2000, titled System and Method For Programming a Route of An Asset, Provisional Patent Application No. 60/225,355, filed on Aug. 15, 2000, titled System and Method For Flexible Insurance Premium Configuration, Provisional Patent Application No. 60/225,357, filed on Aug. 15, 2000, titled System and Method For Location Based Financial Transactions, and Provisional Patent Application No. 60/225,356, filed on Aug. 15, 2000, titled System and Method For Insuring a Good Being Transported Along a Route, all assigned to the assignee of the present invention and incorporated by reference herein.

BACKGROUND

This disclosure is related to transmitting alarms and, more particularly, to a system and method for transmitting a triggered alarm regarding a portion of an asset (such as a truck, car or ship). As an asset travels along a route, various events may occur to the asset, an operator of the asset, and goods being transported by the asset. These events may adversely affect the state of the asset, operator, and goods and/or may cause a delivery delay or loss of the asset and goods.

Prior art systems for handling events relating to an asset include U.S. Pat. No. 5,983,161 in which an automobile is controlled to GPS-based centimeter accuracy in a fully integrated collision avoidance and warning system which detects targets in all directions, develops collision avoidance maneuvers through use of fuzzy logic inference rules and is capable of reliable automatic control in a multiple target, high speed, on-the-highway environment. GPS-based communications between vehicles and between individual vehicles and motor vehicle control centers, directly, or indirectly via an intermediate receiver, such as via a satellite, is possible for optimum real time dissemination of vehicle location and movement vectors and related vehicular data to permit real time calculation of imminent dangerous situations.

U.S. Pat. No. 5,710,559 describes a system for monitoring the flight safety of an aircraft. A monitoring device, having a monitoring unit to be attached to an aircraft, is accommodated in a pod. Sensors for measuring aircraft data independently of the sensors of the aircraft itself are provided in the monitoring unit. There is a device for automatically monitoring the operation of the technical equipment of the monitoring unit. In addition, the monitoring unit contains a system for automatically monitoring the pilot's reactions on the basis of aircraft data provided by the independent sensors. Furthermore, the monitoring unit contains a device which responds to deviations of the aircraft from the range of safe flight states. This device triggers an alarm. There is a device responding to the aircraft inadmissibly approaching ground and a collision warning device, which responds to the risk of collision with other aircraft. Also these devices trigger an alarm in the case of danger.

U.S. Pat. No. 5,334,974 describes a security system that comprises a mobile unit which communicates emergency data including position coordinates, and a central dispatch station which receives the emergency data and accurately displays all necessary emergency information superposed on a digitized map at a position corresponding to the location of the mobile unit. A device for expediting a response by the appropriate authorities whenever and wherever the personal security of a mobile person is compromised is disclosed. The device includes a mobile communication unit and a central station. The mobile communication unit is transported with the mobile person and is triggered by the occurrence of a variety of personal security conditions to establish cellular telephone contact with the central station. The mobile communication unit then communicates longitude and latitude coordinates, emergency, and personal information to the central station.

These prior art systems, however, do not disclose transmitting a triggered alarm detected by a sensor on an asset that comprises a circuit containing a global positioning system (GPS) receiver, a wireless communication unit, a processing unit, a sensor unit and a storage unit operably coupled to one another.

A prior art system describing a circuit containing a GPS receiver is described in U.S. Pat. No. 5,504,684. In this circuit, a GPS receiver's digital signal processing circuitry is incorporated with a microcomputer including its associated peripherals, (e.g., real time clock, serial input/output controllers, analog-to-digital converters, et cetera). As such, circuitry for digital signal processing and an associated microprocessor are combined.

This prior art system, however, does not disclose a storage unit that comprises locations of the asset on a predefined route where events are expected, and wherein the wireless communication unit comprises a wireless transmitter and a wireless receiver.

Therefore, an improved system and method is desired to reduce or eliminate these limitations and complexities.

SUMMARY

In response to these and other limitations, a unique system and method for transmitting a triggered alarm detected by a sensor on an asset is presented. In one embodiment, the alarm is detected by a sensor on an asset that includes a circuit containing a global positioning system (GPS) receiver, a wireless communication unit, a processing unit, a sensor unit and a storage unit operably coupled to one another. The storage unit comprises locations of the asset on a predefined route where events (such as, for example, a door of an asset opening) are expected and the wireless communication unit comprises a wireless transmitter and a wireless receiver. The sensor monitors a portion of the asset (such as, for example, the doors of the asset) while the asset travels along the predefined route. If the portion of the asset triggers an alarm, a current location of the asset is received via the GPS receiver and the event is compared with the locations of the asset on the predefined route. If the event is not expected at the current location, the wireless transmitter sends the alarm and the unexpected event to a data processing system.

These advantages, as well as others which will become apparent, are described in greater detail with respect to the drawings and the following disclosure.

DETAILED DESCRIPTION

Figure 1:
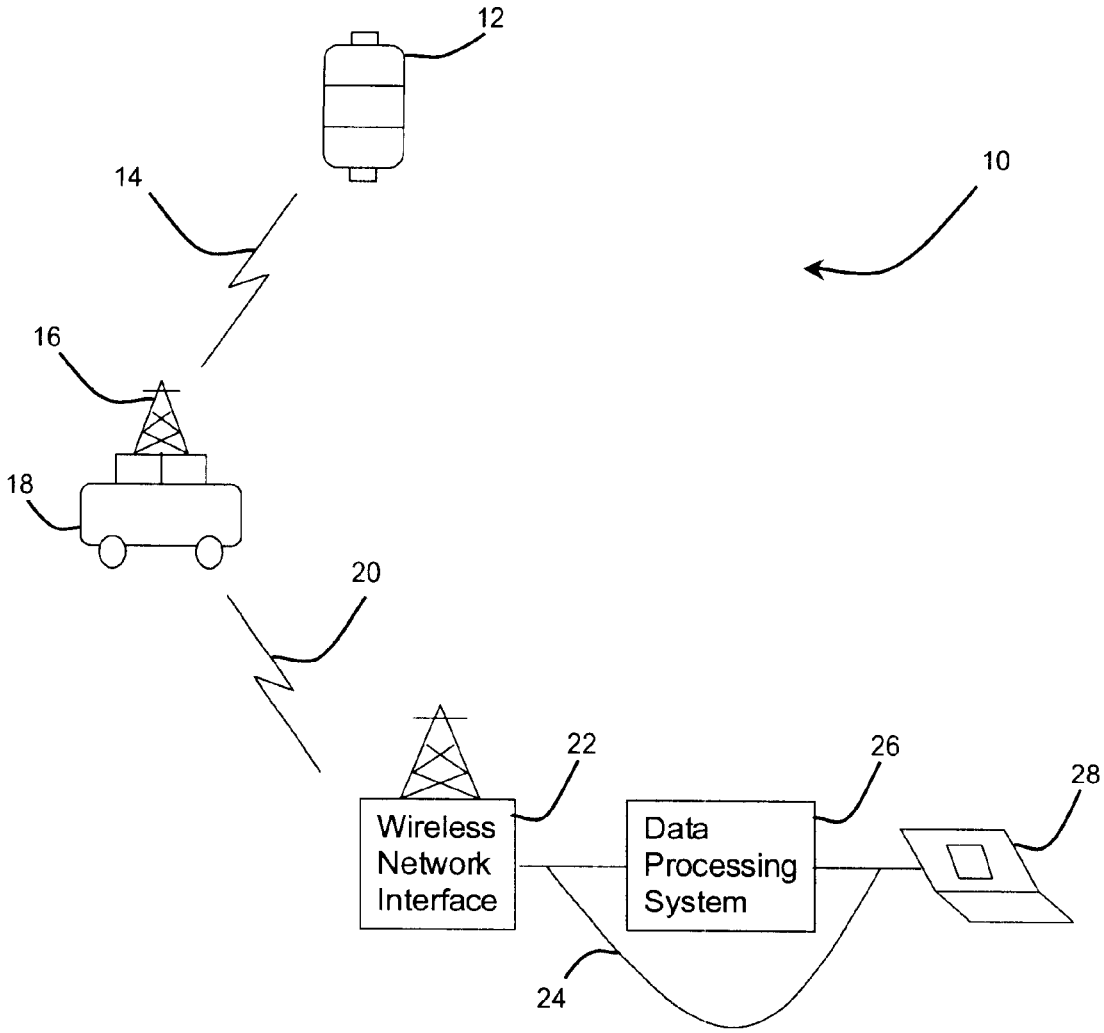
FIG. 1 is a diagrammatic view of a communication network of the present invention.

FIG. 1 depicts a communication network 10 of the present invention. The network includes a GPS satellite 12 (in practice, a plurality of satellites are used) that provides precise geographic location data to an asset's 18 GPS receiver 16 via a wireless communication link 14. The position of the asset is typically reported to a user or system in response to a polling message sent to and received by the GPS receiver 16. A system and method for polling that may be used with the present invention is described in U.S. patent application Ser. No. 09/642,292 entitled SYSTEM AND METHOD FOR LOCATION POLLING OF INDEPENDENT DEVICES IN A COMMUNICATION NETWORK. The GPS receiver 16 may be coupled to various assets such as a vehicle, ship, airplane, and/or any other device that can be used to transport goods, and is connected to a data processing system (or server) 26 via a second wireless communication link 20 and a wireless network interface (or cell site) 22. A location of a good (not shown) being transported may also be tracked if the good is equipped with a transmitting means (such as a GPS capable wireless transmitter, a low power transmitter, etc.) or with a scanning means. The second wireless communication link 20 may be established by any of several conventional methods, such as two-way paging, cellular radio, two-way satellite communications, VHF/UHF radio, or unlicensed spectrum methods, all of which are well known in the art. The wireless network interface 22 receives the location information poll and forwards it to the data processing system 26 via a data network 24 or a third wireless communication link (not shown) that may also be established by the aforementioned conventional methods. The location information and other statistics stored in the data processing system 26, or in a database (not shown) coupled to the data processing system, may be accessed via computer 28 which is operably coupled to the data network 24 (and/or may be wirelessly accessed if, for example, the computer were in the asset 18).

A poll may also be sent from the data processing system 26 to the asset 18 via a satellite wireless network interface (not shown) and a satellite network (not shown) that operates independently from the GPS satellite network. In such a scenario, the receiver 16 must be capable of processing the poll from the satellite and would then send back the asset's location (received form the GPS satellite 12), velocity and direction (based on the location and determined by a computer on the asset) to the data processing system via the satellite network and the satellite wireless network interface.

Alternative methods for providing the location of an asset and/or good can be used with the present invention. For example, a route plan can be provided to an operator of the asset and, when the operator has reached each destination on the route, a message (for example, a paging message) can be sent to acknowledge that fact. As such, the progress of the asset along the route can be monitored. Additionally, an on-board computer can record the location of an asset by either receiving poll information and/or associating an event (for example, the asset not moving) with a location. This location information is recorded, stored (for example in a cartridge, smart key, event recorder, etc.) and then retrieved when the asset returns from the route. Thus, the retrieved information can be used to compare the actual route to the provided route.

Figure 2:
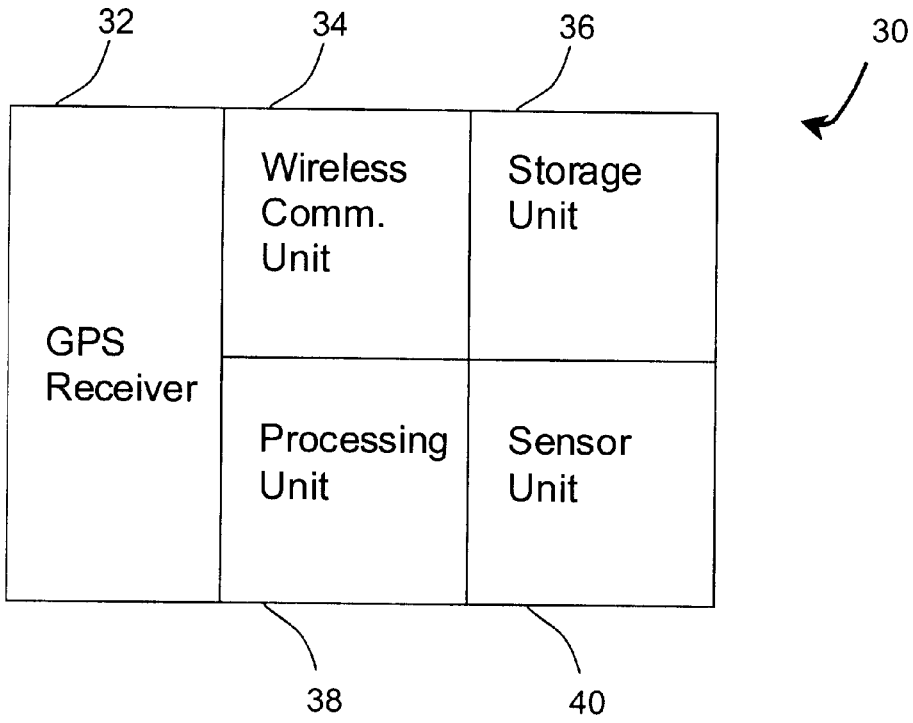
FIG. 2 is a diagrammatic view of a circuit of the present invention.

FIG. 2 depicts a circuit 30 (coupled to the asset 18) that includes a global positioning system (GPS) receiver 32, a wireless communication unit 34, a processing unit 38, a sensor unit 40 and a storage unit 36 operably coupled to one another (either directly or via a bus). The wireless communication unit comprises a wireless transmitter and a wireless receiver and the storage unit 36 comprises locations of the asset 18 (such as a truck, ship, etc.) on a predefined route where events are expected. These locations stored in the storage unit 36 are hardcoded and/or softcoded latitude and longitude pairs. The hardcoded pairs are used in situations when the route of an asset usually does not change (for example an armored truck route) or where security considerations are present (for example, when the asset is transporting sensitive goods such as hazardous materials). Thus, the asset's predefined route cannot be changed thereby ensuring an alarm is triggered if a deviation occurs from the predefined route. The softcoded pairs are used in situations when the route of an asset usually does change such as when the asset 18 is transporting non-sensitive goods such food, basic materials, etc. and/or when the asset is traveling a flexible route. Thus, the asset's predefined route can be changed (via an air interface between the wireless communication unit 34 and an authorized unit (not shown)) thereby ensuring an alarm is not triggered if a deviation occurs from the predefined route. The softcoded pairs may be changed to more efficiently route the asset 18 to its destination, to allow the asset to dynamically pick-up and/or deliver goods to other locations, etc. Further, the softcoded route may only be provided to the asset/operator when the asset is about to move and/or when the asset has just begun to move.

The direction and velocity of the asset are also important to consider when triggering an alarm. For example, an asset may be traveling in an opposite direction than the predetermined route suggests. In such a scenario, the asset may either be: traveling in the opposite direction for a valid reason (such as, for example, because of a missed turn or exit), traveling in the opposite direction for an invalid reason (such as, for example, because it is being stolen). As such, at a certain distance and direction away from the predefined route, an alarm will be triggered.

The sensor unit 40 monitors a portion of the asset 18 as it is traveling along the predefined route and determines when a deviation from the latitude and longitude pairs occurs. If the portion of the asset 18 triggers the alarm (because, for example, a cargo door has unexpectedly opened), a current location of the asset is received via the GPS receiver 32 and the event is compared with the locations of the asset on the predefined route. If the event is not expected at the current location, the wireless transmitter sends the alarm and the unexpected event to the data processing system 26 via the wireless network interface 22 and the data network 24. An alarm is also triggered if the asset is not traveling along the predefined route.

The processing unit 38 receives the alarm and the unexpected event and sends both to the wireless transmitter which forwards them to the data processing system 26 via the wireless network interface 22. Information received by the data processing system 26 includes a type of triggered alarm/event, a description of the alarm/event, a severity of the alarm/event, a time the alarm was triggered, a velocity of the asset when the alarm was triggered, and a direction of the asset when the alarm was triggered. This alarm and other information is sent via a plurality of protocols including, but not limited to: paging, two-way radio, Cellular Digital Packet Data, Advanced Mobile Phone System, Global System for Mobile communications, Code Division Multiple Access, and Time Division Multiple Access.

Upon receiving the alarm and/or information related to the alarm, the data processing system 26 may send a query message to the wireless transmitter. Information about the alarm such as indications to the cause of the alarm, actions to take and a confirmation of the occurrence of the alarm (by the circuit 30 and/or an operator of the asset 18), may be included in the query message. As such, instructions regarding the handling of the unexpected alarm can be sent to ensure the safety of the operator and the asset, and the timely delivery of the good.

The portion of the asset 18 that the sensor unit 40 monitors includes, but is not limited to: a speed gauge, a fuel gauge, an oil gauge, a door, a hood, a trunk, an air bag, a horn, tire pressure, brakes, an ignition, wheel rotation, engine related information (such as a radiator overheating, engine statistics, etc.), a direction of the asset, a velocity of the asset (which may also be stationary), and goods transported by the asset. A plurality of sensors can monitor a plurality of portions of the asset and a plurality of assets may be concurrently monitored. Expected events, unexpected events, alarms, other asset related information and/or expected events that did not occur can be sent to and stored in the data processing system 26, in a database coupled to the data processing system (not shown), and/or in the storage unit 36. The data processing system 26 is then able to provide statistics related to: the expected events, unexpected events, alarms, asset related information, and the portion of the asset.

In an alternate embodiment, if the portion of the asset triggers the alarm, a current location of the asset is received, the alarm is compared with the locations of the asset on a predefined route where alarms are expected and, if the alarm is not expected at the current location, the unexpected alarm is sent to a data processing system.

In another alternate embodiment, if the portion of the asset triggers the alarm, a current location of the asset is received, an event causing the alarm is compared with the locations of the asset on a predefined route where events are expected and, if the event is not expected at the current location, the unexpected event is sent to a data processing system.

In a further alternate embodiment, a means is provided for determining, by a circuit monitoring the asset, when the asset has diverged from the predefined route and a means is provided for alerting, by the circuit, a data processing system of the divergence.

Figure 3:
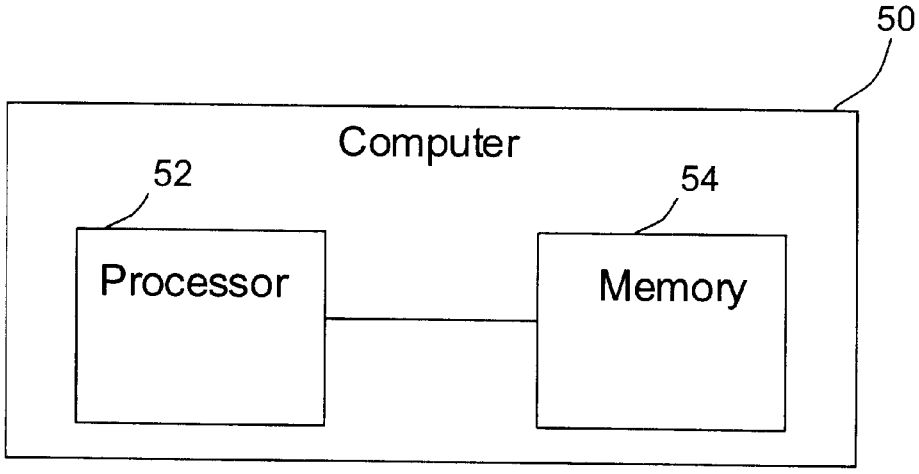
FIG. 3 is a computer of the present invention.

FIG. 3 depicts a computer 50 of the present invention that comprises a processor 52 that is operably coupled to a memory 54. The computer 50, which contains programming instructions, may be a personal computer or laptop, the GPS satellite 12, the GPS receiver 16, the wireless communication link 14, the data processing system/server 26, the second wireless communication link 20, the wireless network interface/cell site 22, the data network 24, the computer 28, and/or any device that can transmit, receive, and share information. The processor 52 may be a central processing unit, digital signal processor, microprocessor, microcontroller, microcomputer, and/or any device that manipulates digital information based on programming instructions. The memory 54 may be read-only memory, random access memory, flash memory and/or any device that stores digital information. A computer readable medium and/or the memory 54 store programming instructions that, when read by the processor 52, cause the processor to perform the actions discussed above with reference to FIG.'S 1–2.

The present invention thus enjoys several advantages. For example, a circuit is presented that comprises a GPS receiver, a wireless communication unit, a processing unit, a sensor unit; and a storage unit all operably coupled to one another. The storage unit comprises hardcoded and/or soft-coded latitude and longitude pairs while the sensor unit determines when a deviation from the pairs occurs. When a deviation does occur, a current location of the asset is received and the processing unit sends an alarm relating to the deviation to the data processing system via the wireless communication unit. Further, the route of the asset can be programmed in a memory on the asset where the route is associated with expected events to occur to the asset at various locations on the route. If the events are triggered by the asset as it travels along the route, these triggered events are detected by sensors on the asset. A current location of the asset is received via the GPS receiver and a processor compares the triggered events with the current location. If the triggered events were not expected at the current location, a wireless transmitter on the asset sends an alarm associated with the triggered events to a data processing system. As such, asset theft can be prevented and dangerous situations can be addressed in an expedited manner if an alarm and/or an unexpected event occurs.

It is understood that variations may be made in the foregoing without departing from the scope of the present invention. For example, any number and combination of entities such as the GPS satellite 12, the GPS receiver 16, the wireless communication link 14, the data processing system/server 26, the second wireless communication link 20, the wireless network interface/cell site 22, the data network 24, the computer 28, the computer 50, the processor 52, and the memory 54 may comprise or be used with the present network 10. Further, the network 10 may be connected to another wireless, wireline, data, voice, and/or multi-media network. Also, the programming instructions that facilitate the transmission of a triggered alarm may be fully and/or partially contained in the entities and/or computers described above. Additionally, other components, such as a power supply, input/output devices, and buses (not shown) may also be included in the computers 28 and 50. Further, the system 26 may be connected to the computer 30 via a wireless communication link (not shown) such as wireless communication link 20 and/or may be stored in the computer 28. Still further, other components typically found in communication networks may be used in the present network 10.

It is further understood that other modifications, changes and substitutions are intended in the foregoing disclosure and in some instances some features of the disclosure will be employed without corresponding use of other features. Additionally, singular discussion of items and/or computers located in the network 10 is also meant to apply to situations where multiple items and/or computers exist. Accordingly, it is appropriate that the appended claims be construed broadly and in a manner consistent with the scope of the disclosure.

What we claim is:

1. A method for transmitting a triggered alarm detected by a sensor on an asset, wherein the asset comprises a circuit containing a global positioning system (GPS) receiver, a wireless communication unit, a processing unit, a sensor unit and a storage unit operably coupled to one another, wherein the storage unit comprises locations of the asset on a predefined route where events are expected, and wherein the wireless communication unit comprises a wireless transmitter and a wireless receiver, the method comprising:

monitoring, by the sensor, a portion of the asset;

traveling, by the asset, along the predefined route; and if the portion of the asset triggers an alarm:

receiving a current location of the asset via the GPS receiver;

comparing the event with the location of the asset on the predefined route; and if the event is not expected at the current location, sending, by the wireless transmitter, the alarm to a data processing system.

2. The method of claim 1 further comprising sending, by the data processing system to the asset via the wireless transmitter, a query message regarding the alarm.

3. The method of claim 2 further comprising, if the unexpected event has occurred, confirming, by an operator of the asset, the occurrence of the unexpected alarm.

4. The method of claim 2 further comprising, if the unexpected event has not occurred, confirming, by an operator of the asset, the non occurrence of the unexpected event.

5. The method of claim 3 further comprising sending instructions to the operator for handling the unexpected event.

6. The method of claim 1 further comprising receiving a time the alarm was triggered.

7. The method of claim 1 further comprising receiving a velocity of the asset when the alarm was triggered.

8. The method of claim 1 further comprising receiving a direction of the asset when the alarm was triggered.

9. The method of claim 1 further comprising receiving, by the processing unit, the unexpected event.

10. The method of claim 9 further comprising sending, by the processing unit, the unexpected event to the wireless transmitter.

11. The method of claim 1, wherein the wireless communication unit can communicate via a plurality of protocols including: paging, two-way radio, Cellular Digital Packet Data, Advanced Mobile Phone System, Global System for Mobile communication, Code Division Multiple Access, and Time Division Multiple Access.

12. The method of claim 1, wherein the portion of the asset is related to a speed gauge.

13. The method of claim 1, wherein the portion of the asset is related to a fuel gauge.

14. The method of claim 1, wherein the portion of the asset is related to an oil gauge.

15. The method of claim 1, wherein the portion of the asset is related to a door.

16. The method of claim 1, wherein the portion of the asset is related to an air bag.

17. The method of claim 1, wherein the portion of the asset is related to a horn.

18. The method of claim 1, wherein the portion of the asset is related to tire pressure.

19. The method of claim 1, wherein the portion of the asset is related to goods transported by the asset.

20. The method of claim 1, wherein the portion of the asset is related to an ignition.

21. The method of claim 1, wherein a direction of the asset is monitored by the sensor.

22. The method of claim 1, wherein a velocity of the asset is monitored by the sensor.

23. The method of claim 1, wherein the asset may be stationary.

24. The method of claim 1, wherein the data processing system receives the alarm via a wireless network interface coupled to a data network, and wherein the data network is coupled to the data processing system.

25. The method of claim 1 further comprising monitoring, by a plurality of sensors, a plurality of portions of the asset.

26. The method of claim 1 further comprising monitoring, by the sensor, a plurality of assets.

27. The method of claim 1 further comprising storing, in a database coupled to the data processing system, the:

expected events;

expected events that did not occur;

unexpected events; and alarms.

28. The method of claim 1 further comprising storing, in the storage unit, the:

expected events;

expected events that did not occur;

unexpected events; and alarms.

29. The method of claim 1 further comprising, providing, by the data processing system, statistics related to the:

expected events;

expected events that did not occur;

unexpected events; and alarms.

30. The method of claim 1 further comprising, providing, by the data processing system, statistics related to the portion of the asset.

31. The method of claim 1 further comprising, triggering an alarm if the asset is not traveling along the predefined route.

32. A method for transmitting a triggered alarm detected by a sensor on an asset, wherein the asset comprises a global positioning system (GPS) receiver and a wireless transmitter, the method comprising:

traveling, by the asset, along a predefined route;

monitoring, by the sensor, a portion of the asset; and if the portion of the asset triggers the alarm:

receiving a current location of the asset via the GPS receiver;

comparing the alarm with the locations of the asset on the predefined route where alarms are expected; and if the alarm is not expected at the current location, sending, by the wireless transmitter, the unexpected alarm to a data processing system.

33. A method for triggering an alarm based on a route of an asset, wherein the asset comprises a sensor, a global positioning system (GPS) receiver, a wireless transmitter, a processor and memory, the method comprising:

programming the route of the asset in the memory, wherein the route is associated with expected events to occur to the asset at various locations on the route;

traveling, by the asset, along the route;

if the events are triggered, detecting the triggered events by the sensor;

receiving a current location of the asset via the GPS receiver;

comparing, by the processor, the triggered events with the current location; and if the triggered events were not expected at the current location, sending, by the wireless transmitter, an alarm associated with the triggered events to a data processing system.

34. The method of claim 33 wherein the route of the asset associated with the expected events is stored in the data processing system.

35. A circuit comprises:

a global positioning system (GPS) receiver;

a wireless communication unit;

a processing unit;

a sensor unit adapted to monitor a portion of an asset traveling along a predefined route; and a storage unit, wherein the GPS receiver and the units are operably coupled to one another, wherein the storage unit comprises hardcoded latitude and longitude pairs related to the predefined route and wherein the sensor unit determines when a deviation from the pairs occurs.

36. The circuit of claim 35 wherein the GPS receiver is polled to receive a current location of the asset.

37. The circuit of claim 35 wherein the processing unit sends an alarm relating to the deviation to the wireless communication unit.

38. The circuit of claim 37 wherein the wireless communication unit sends the alarm to a data processing system.

39. The circuit of claim 35 wherein the storage unit comprises softcoded latitude and longitude pairs.

40. A computer readable medium comprising instructions for:

monitoring a portion of an asset; and if the portion of the asset triggers an alarm:

receiving a current location of the asset;

comparing the current location with a last known location of the asset on a predefined route; and sending the compared information.

41. A computer readable medium comprising instructions for:

traveling, by an asset, along a predefined route;

monitoring a portion of the asset; and if the portion of the asset triggers an alarm:

receiving a current location of the asset;

comparing an event causing the alarm with the locations of the asset on the predefined route where events are expected; and if the event is not expected at the current location, sending, the unexpected event to a data processing system.

42. A method for transmitting a triggered alarm detected by a sensor on an asset, wherein the asset comprises a circuit containing a global positioning system (GPS) receiver, a wireless communication unit, a processing unit, a sensor unit and a storage unit operably coupled to one another, wherein the storage unit comprises locations of the asset on a predefined route where events are expected, and wherein the wireless communication unit comprises a wireless transmitter and a wireless receiver, the method comprising:

monitoring, by the sensor, a portion of the asset as the asset travels along the predefined route; and if the portion of the asset triggers an alarm:

receiving a current location of the asset via the GPS receiver;

comparing the event with the location of the asset on the predefined route; and if the event is not expected at the current location, sending, by the wireless transmitter, the alarm to a data processing system.

43. A method for transmitting a triggered alarm detected by a sensor on an asset, wherein the asset comprises a global positioning system (GPS) receiver and a wireless transmitter, the method comprising:

monitoring, by the sensor, a portion of the asset as the asset travels along the predefined route; and if the portion of the asset triggers the alarm:

receiving a current location of the asset via the GPS receiver;

comparing the alarm with the locations of the asset on the predefined route where alarms are expected; and if the alarm is not expected at the current location, sending, by the wireless transmitter, the unexpected alarm to a data processing system.

44. A method for triggering an alarm based on a route of an asset, wherein the asset comprises a sensor, a global positioning system (GPS) receiver, a wireless transmitter, a processor and memory, the method comprising:

programming the route of the asset in the memory, wherein the route is associated with expected events to occur to the asset at various locations on the route as the asset travels along the route;

if the events are triggered, detecting the triggered events by the sensor;

receiving a current location of the asset via the GPS receiver;

comparing, by the processor, the triggered events with the current location; and if the triggered events were not expected at the current location, sending, by the wireless transmitter, an alarm associated with the triggered events to a data processing system.

45. A computer readable medium comprising instructions for:

monitoring a portion of an asset as the asset travels along a predefined route; and if the portion of the asset triggers an alarm:

receiving a current location of the asset;

comparing an event causing the alarm with the locations of the asset on the predefined route where events are expected; and if the event is not expected at the current location, sending, the unexpected event to a data processing system.

* * * * *